US006772845B1

(12) United States Patent
Jansson

(10) Patent No.: US 6,772,845 B1
(45) Date of Patent: Aug. 10, 2004

(54) DETECTOR ARRANGEMENT FOR DETECTION OF FIRE RISK IN A PROCESS PLANT

(75) Inventor: Lennart Karl Erik Jansson, Värmdö (SE)

(73) Assignee: Firefly AB, Stockholm (SE)

( * ) Notice: Subject to any disclaimer, the term of this patent is extended or adjusted under 35 U.S.C. 154(b) by 177 days.

(21) Appl. No.: 09/979,035

(22) PCT Filed: Jun. 5, 2000

(86) PCT No.: PCT/SE00/01158

§ 371 (c)(1),
(2), (4) Date: Nov. 30, 2001

(87) PCT Pub. No.: WO00/74786

PCT Pub. Date: Dec. 14, 2000

(30) Foreign Application Priority Data

Jun. 7, 1999 (SE) ..... 9902121

(51) Int. Cl.[7] ..... A62C 37/00

(52) U.S. Cl. ..... 169/54; 169/60; 169/61; 340/321

(58) Field of Search ..... 169/54, 60, 61; 340/521, 522, 584

*Primary Examiner*—Michael Mar
*Assistant Examiner*—Thach H Bui
(74) *Attorney, Agent, or Firm*—Dykema Gossett PLLC

(57) ABSTRACT

The invention comprises a detector arrangement adjustable for inclusion in a preventive protective system for a process plant comprising at least two sensor units (10, 10'), a unit (16*a*, 16*b*) for evaluating the output signal of each sensor unit and a calculation unit (17) capable of co-operating with the evaluating units (16*a*, 16*b*), the output signals of which calculation unit can cause an activating unit (18) to pass from a first position to a second position. One or more of a first category of sensor units (10) is designed, via its circuit (16*a*) for evaluating output signals, to be able to determine the energy content of a particle present. One or more of a second category of sensor units (10') is designed, via its circuit (16*b*) for evaluating output signals, to be able to determine the fire tendency or tendency to some other damage of the particle surroundings. The activating unit (18) is designed to pass from a first position to a second position only when the combined energy content and the tendency determined in said calculation circuit (17) indicate high risk of fire or other damage.

12 Claims, 1 Drawing Sheet

Fig. 1
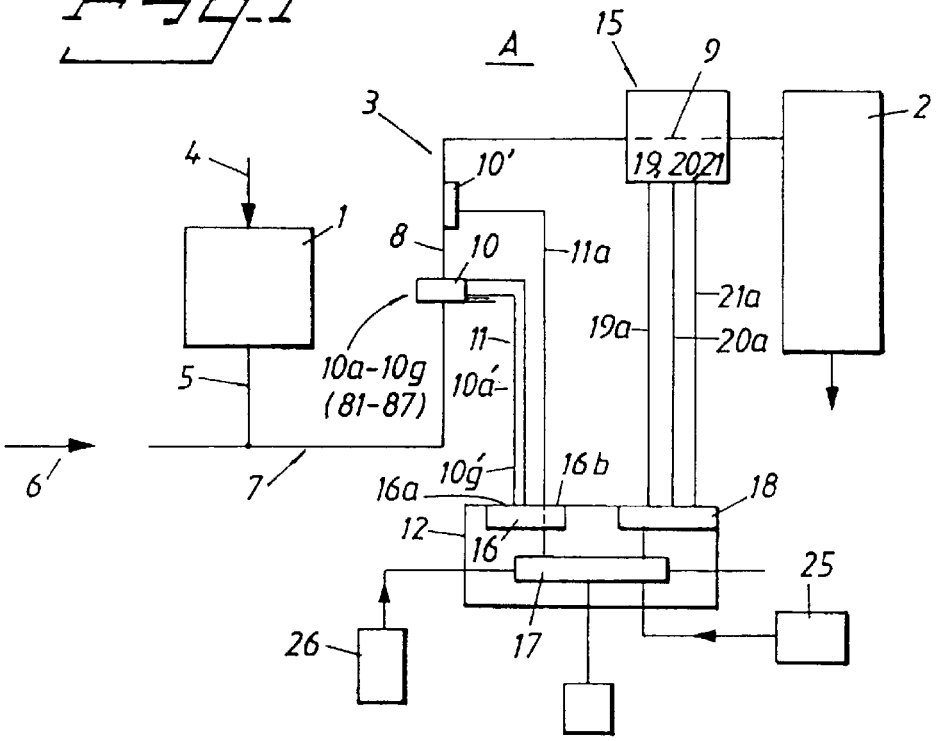
Fig. 2
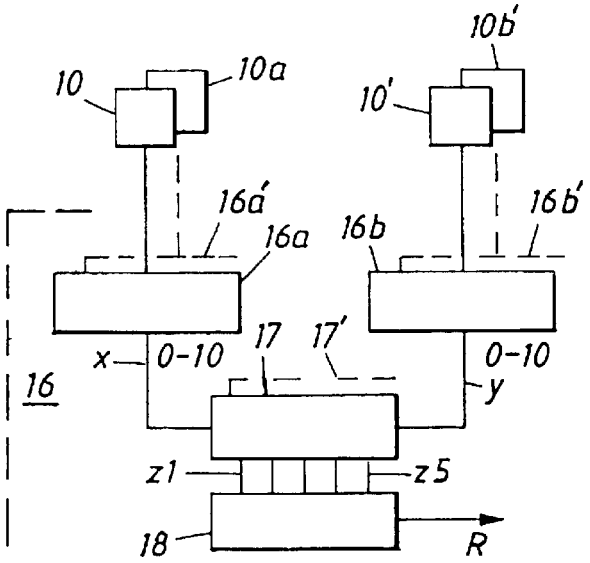
Fig. 3
| x | y | z1 | z5 |
|---|---|---|---|
| 3 | 3 | x | |
| 2 | 4 | x | |
| 1 | 4 | | |
| 1 | 5 | | x |
Fig. 4
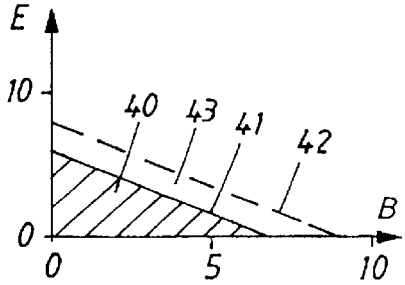

DETECTOR ARRANGEMENT FOR DETECTION OF FIRE RISK IN A PROCESS PLANT

TECHNICAL FIELD

The present invention relates to a detector arrangement and more particularly to a detector arrangement that is adjustable for inclusion in a preventive protective system for a process plant.

The detector arrangement according to the invention comprises at least two sensor units, with a unit for evaluating the output signal of each sensor unit and an activating unit capable of co-operating with the evaluating units.

The activating unit is designed so that, dependent on the output signals from the evaluating units, preferably via a calculation circuit, it can be caused to pass from a first position to a second position, where the second position may be intended more or less to activate one or more means for preventing damage.

The phrase "more or less to activate" said activating unit means to control said means towards a degree of activation corresponding to an assumed requirement.

BACKGROUND ART

Various embodiments of detector arrangements of the type described in the introduction are already known.

Reference is made to the content of U.S. Pat. No. 5,749,420 as an example of the background art.

Considering the features associated with the present invention, the content of U.S. Pat. No. 5,740,867 may also be mentioned as previously known.

DESCRIPTION OF THE PRESENT INVENTION

Technical Problem

Considering the circumstance that the technical deliberations one skilled in the relevant technical art must perform in order to offer a solution to one or more technical problems posed, are initially an insight into the courses of action and/or the sequence of courses of action to be taken and also a choice of the means required, and on the basis thereof, the following technical problems should be relevant in arriving at the present inventive concept.

Taking into consideration the previous state of the art as described above, it must be deemed a technical problem to be able to create such conditions in a preventive protective system for a process plant that, one the one hand, the number of influences on the activating unit that would not have entailed some risk of fire or other damage is reduced and, on the other hand, not to refrain from an influence on the activating unit on such occasions that would have resulted in damage.

It is thus also a technical problem, at every effort and course of action undertaken with the object of reducing the number of influences, to create conditions for a reliable evaluation of the relevant criteria that affects the risk of fire or other damage.

It is thus also a technical problem to be able to perceive the significance of and the advantages associated with, with great accuracy, not only having the thermal energy of a particle or the combined thermal energy of a number of particles and/or the glow or flame of a particle evaluated, but also hsving the tendency of a material flow to initiate fire or other damage due to the presence of an evaluated particle, determined.

A technical problem is entailed in co-ordinating information as to current energy content and information as to the tendency for damage occurring, so that the activating unit is influenced with greater accuracy than previously.

A technical problem is entailed in improving the effect of and the total result obtained from sensor units and detector arrangements with associated calculation circuits utilised so that a safety margin between energy content of a particle and the tendency of a material flow to initiate fire or other damage due to the presence of this particle, can be controlled and kept small without a deficiency occurring in the ability of the activating unit to be influenced when the energy content in a sensed particle in a known environment created in the media flow will be able to cause damage.

A technical problem is entailed in being able to perceive the significance of and advantages associated with not only evaluating the energy content of an individual particle (or the total or calculated energy content of a plurality of densely oriented particles), but also observing the momentary tendency of the material flow, as a result of the presence of this particle, to cause fire or other damage in a conveyor and/or a silo or the like.

A technical problem is entailed in being able to perceive the significance of not just refining the design of one or more of a first category of sensor units that are designed, via their circuits for evaluating an output signal, to be able to determine the energy content of a particle present with great accuracy, but also to perceive the significance of utilising one or more sensor units of a second category designed, via their circuits for evaluating an output signal, to be able to determine the tendency of the particle surroundings to fire or other damage.

A technical problem is entailed in being able to perceive the significance of and advantages associated with allowing an activating unit to be designed to pass from a first position (rest position) to a second position (active position) only when a momentary combined energy content and the determined tendency to fire or other damage, to indicate a risk of fire or other damage, and where a calculated risk may then lie extremely close to, but still below the actual risk or the risk value for fire or other damage.

A technical problem is thus entailed in, on the basis of information received relating to the energy content of a particle and the tendency of the surrounding environment to combustion or other damage, being able to perform an adequate calculation of the probability and/or possibility of damage.

A technical problem is entailed in being able to perceive the significance of and advantages associated with allowing an activating unit to be designed still to assume a first position when a momentary combination of determined energy content and determined tendency to fire or other damage admittedly indicates a risk of fire or other damage, but when a calculated risk value lies very close to, but still below the actual value for fire or other damage, reduced by a risk margin.

A technical problem is also entailed in being able to perceive the significance of utilising one or more units of said first category and one or more sensor units of said second category.

A technical problem is entailed in being able to perceive the significance of and advantages associated with allowing said first category of sensor units for evaluating the energy content of existing particles, to be based on temperature sensing, wave-length analysis and/or the use of one or more second sensor units.

A technical problem is entailed in being able to perceive the significance of and advantages associated with, within said second category of sensor units, allowing one sensor unit to be used where sensing the temperature determines the tendency of the material flow, and thus the particle surroundings, to fire or other damage.

A technical problem is also entailed in being able to perceive the significance of allowing a sensor unit to be used that is especially designed to be able to sense the moisture content in the material flow, and thus in the particle surroundings.

A technical problem is also entailed in being able to perceive the significance of utilising a sensor unit that is designed to be able to determine the fire tendency or other damage of the particle surroundings by means of sensed oxygen content.

It should no doubt also be deemed a technical problem to be able to perceive the significance of and advantages associated with allowing a sensor unit to be used that is designed to be able to determine the tendency of the particle surroundings to fire or other damage by means of evaluating the dust concentration.

It should furthermore no doubt be deemed a technical problem to allow a sensor unit to be used that is designed to be able to determine the tendency to fire or other damage of the particle surroundings by means of evaluating the particle size.

It should furthermore no doubt be deemed a technical problem to provide a sensor unit that is designed to be able to determine the tendency to fire or other damage of the particle surroundings by means of evaluated turbulence intensity in the material flow within a pipe section.

It is also a technical problem to be able to perceive the significance of and advantages associated with allowing said sensor unit to be designed to be able to determine the tendency to fire or other damage of the particle surroundings, or alternatively the ignition energy required, by means of evaluating the ignition temperature.

A technical problem is also entailed in being able to perceive the significance of and advantages associated with allowing one or more of the sensor units mentioned above, to be used in order to be able to determine the tendency of the particle surroundings to fire or other damage on the basis of various criteria.

A technical problem is also entailed in being able to perceive the significance of and advantages associated with allowing the unit evaluating the output signal of each sensor unit to emit its own value, one representing the energy content, one representing the fire tendency or tendency to other damage of the particle surroundings, and allowing a list or algorithm included in the calculation circuit to determine if and how the activation circuit shall be influenced and which extinguishing arrangement(s), amongst a plurality of alternative means available, shall be activated or, by means of calculations, evaluate what action shall be taken.

It should similarly be deemed a technical problem, on the basis of criteria stipulated, to select the second, active, position depending on the energy content and/or thermal content, and to determine the tendency to fire or other damage in order to be able to evaluate and select one or more of a plurality of available courses of action.

Solutions

To enable solution of one or more of the technical problems described above, the present invention takes as its point of departure a detector arrangement adjustable for inclusion in a preventive protective system for a process plant comprising at least two different categories of sensor units, a unit for evaluating the output signal of each sensor unit and a calculation circuit and activating unit capable of co-operating with the evaluating units, said activating unit being capable, dependent on the output signals from the evaluating units, of being caused to pass from a first position to a second position The present invention shows particularly that one or more sensor units included in a first category of sensor units shall be designed, via its circuit for evaluating output signals, to be able to determine the energy content of a particle present, that one or more sensor units included in a second category of sensor units shall be designed, via its circuit for evaluating output signals, to be able to determine the tendency of the particle surroundings to fire or some other damage.

It is also stated that the activating unit shall be designed to pass from a first position to a second position only when the combined energy content and the tendency determined indicate risk of fire or other damage.

Proposed embodiments falling within the scope of the inventive concept show that among the sensor units falling within said first category one sensor unit shall be designed to determine the energy content of a particle occurring by means of temperature sensing and/or wave-length analysis.

It is also stated that among the sensor units falling within said second category of sensor units one may be designed to determine the tendency of the particle surroundings to fire or other damage by means of temperature sensing.

The second category of sensor units may also include a sensor unit designed to be able to offer moisture content sensing, a sensor unit for sensing oxygen content, a sensor unit for sensing dust concentration, a sensor unit for sensing particle size of the transported material, a sensor unit for sensing turbulence intensity, in order therefrom to determine an ignition temperature or, alternatively, the ignition energy required.

The invention also shows that the unit evaluating the output signal of each sensor unit shall emit its own value, one representing the energy content, one representing the fire tendency or tendency to other damage of the particle surroundings, and that a list or algorithm included in a calculation unit will determine if, and in that case, how the activation circuit shall be affected.

Advantages

The foremost advantages that may be considered characterizing for a detector arrangement in accordance with the present invention are that conditions are provided, with the aid of a first category of sensor units, that enable evaluation of the energy content in a particle occurring in a preventive protective system for a process plant, and also the use of a second category of sensor units that are designed, via a circuit evaluating their output signals, to be able to determine the tendency of the particle surroundings to fire or other damage, and that both these criteria in combination shall indicate momentary risk of fire or other damage, and when a calculated probability and/or possibility of damage exceeds a predetermined value, the activating unit is activated to pass from a first position to a second position and thereby selectively activate one or more devices or means pertaining to the process plant in order thereby to extinguish fire or prevent other damage.

The principal characteristic features for a detector arrangement showing the significant features of the present invention are defined in the characterizing part of the appended claim 1.

BRIEF DESCRIPTION OF THE DRAWINGS

A process plant into which a preventive protective system has been incorporated, and also a detector arrangement in accordance with the present invention will now be described in more detail with reference to the accompanying drawings in which FIG. 1 shows the process plant with the preventive protective system, FIG. 2 shows the detector arrangement in accordance with the invention, with a first category of sensor units and a second category of sensor units, FIG. 3 shows a list included in a calculation unit, by means of which it is determined if, and to what extent, one or more activating circuits shall be influenced in order, as required, to be able to select one or more devices or means to prevent damage, and FIG. 4 shows a graph where the energy content and the environment of the particle surroundings are coordinated via a selected algorithm.

DESCRIPTION OF PREFERRED EMBODIMENTS

FIG. 1 thus shows a preventive protective system usable in a process, an industrial process or process plant in which a loosely formed material pertaining to the process is produced in a first unit and is transportable to a receiving second unit 2 via a conveyor 3.

After treatment, such as disintegration of paper pulp supplied at the arrow 4 to a mill 1, the material shall now be conveyed further via a discharge pipe 5. The treated material is thus in disintegrated form, such as digester fluff, and is conveyed by means of an air current 6 via a pipe system 7, 8, 9 included in the conveyor 3, to a second unit 2 in the form of a silo.

The exemplified disintegration of paper pulp in the unit or mill 1 may produce one or more individual particles with a temperature sufficiently high to be able to initiate fire and/or explosion in at least the second part 2, but also in the conveyor 3.

Although the embodiment by way of example shows the use of paper pulp that is to be disintegrated to fluff which is to be transported by an air flow to a silo, it is obvious that the inventive concept is also applicable to other technical areas, for other purposes and especially for other materials.

Another requirement is that all disintegrated particles are transported as loose material by a gas or a gas mixture, usually air.

It is also necessary for the treatment performed in the unit 1 to be of such a nature that it could generate occasional particles having a thermal content or thermal energy constituting an incitement to fire in a pipe or storage space, the so-called risk zone 2.

The process plant shown in FIG. 1 is based on the necessary transport of the loosely formed material via the system 3 occurring in the pipe 5 between said first unit 1 and said second unit 2, being allocated a stabilising zone 7, said zone 8 indicating individual particles with high temperature, and an extinguishing zone 9, all of these being located before said risk zone 2.

Said indicating zone 8 initially contains a plurality of sensors 10, with one or more sensor units or sections 10*a*–10*g*, designed as shown and described in more detail in Swedish patent application No. 98 04579-2 entitled "Detector arrangement". Said sensor units 10*a*–10*g* may be oriented in one and the same plane across the pipe 8 or they may be at a suitable distance from each other along the pipe 3.

It is obvious to one skilled in the art how the signals from several sensor units can be evaluated and how introduction of time factors can be effected in order to evaluate signals for sensor units spaced from each other and this is therefore not explained in detail.

A chosen number of sensor sections or units 10*a*–10*g* may cooperage via a stranded wire 11 with a unit evaluating the output signal of each sensor section, co-ordinated at 16, connected to or included in an activating unit 12. In the event of an indication generated by a selected number of sensor sections 10*a*–10*g*, of the occurrence of individual particles that are too hot, the unit 12 will activate an arrangement 15, pertaining to an extinguishing zone 9, which arrangement supplies extinguishing agent and/or removes particles.

Additional designations have been introduced in FIG. 1 and reference is made to the Swedish patent application mentioned above in order to acquire a deeper insight into the construction of the process plant. Said Swedish patent application shall be considered as a part of the present invention and application.

FIG. 2 shows that the sensor unit 10 constitutes one of several sensor units pertaining to a first category, that are designed via the circuit 16*a* evaluating their output signals, to be able to determine the energy content of a particle occurring.

The circuit 16*a* is thus shown especially designed for the sensor unit 10.

A second circuit 16*a*' may advantageously be designed for a second sensor unit, such as the sensor unit 10*a*, and the invention also shows the use of additional sensor units with additional circuits. However, these are not shown in further detail for the sake of simplicity.

FIG. 2 also shows a sensor unit 10'. This sensor unit constitutes one of many sensor units pertaining to a second category and this sensor unit 10' is designed to be able to determine the tendency of the particle surroundings and material flow to fire or other damage, via its circuit 16*b* evaluating its output signal.

Here, too, a plurality of sensor units are used, such as the sensor unit 10*b*' which has a similar circuit 16*b*' for each such sensor unit.

For the purpose of simplification the following description will only deal with the sensor unit 10 with the circuit 16*a* since the equivalent is applicable to the others.

The division of the sensor units into two categories described here is performed for the purpose of simplification and clarification. However, in practice a single sensor unit would be possible.

It is presumed that the sensor unit 10 pertaining to the first category is designed to be able to determine the energy content of a particle, via its output signal and the evaluating circuit 16*a*. The sensor unit 10 is presumed to evaluate the energy content via spectra analysis.

To simplify an understanding of the present invention, it is assumed that an evaluated energy content will have a value of between 0 and 10, where 0 indicates no energy content and 10 indicates an unacceptably high energy content.

In similar manner it is assumed that the sensor unit 10' pertaining to the second category is designed to be able to determine the tendency of the particle surroundings to fire or other damage, via its output signal to the evaluating circuit 16*a*, and to indicate this in the digital values 0–10, where 0 is no tendency and 10 a high tendency.

The sensor unit 10' evaluates the moisture content in the media flow.

This assumption will also be described in more detail in the following, with reference to FIG. 3 and FIG. 4.

In FIG. 2, thus, the measured values 0–10 from the circuit 16*a* will appear on the wire x while the measured values 0–10 for the circuit 16*b* will appear on the wire y, and these measured values will enter a calculation unit 17.

This calculation unit 17 contains a list, as illustrated in FIG. 3, said list containing all possible combinations of x and y within the values 0–10 and, depending on which value appears, one of five output signals will be generated from the circuit 17 to the activation unit 18 in order, depending on the signals on one or more of the wires z1–z5, to activate a course of action corresponding to the signal.

FIG. 3 is thus intended to illustrate that, if the circuit 16*a* evaluates the energy content of a particle occurring to 3, whereas the circuit 16*b* evaluates the tendency of the particle surroundings to fire or other damage to 3, the course of action z1 shall be taken.

If the measured values were 2 and 4, then course of action z2 would be activated.

However, if the measured value x were to be 1 and the measured value y were to be 4, such circumstances exist in the preventive protective system that no action need be taken.

However, if the value x were to be 1and the value y were to be 5, a course of action z5 is required to be activated.

The activation unit 18 is thus designed to be able to pass from a first position to a second position only when the coordinated stipulated energy content and stipulated tendency indicate, via the list according to FIG. 3, that there is a risk of fire or other damage and signals on the wires z1 and z5 indicate between them a selection of various courses of action.

If the sensor unit 10*a* is also used for temperature sensing, and 10*b*' for sensing the temperature of the media flow, a value is obtained via the circuit 17' which is connected to the activation unit 18 via wires (not shown). A choice of action must now be made, taking into consideration output signals from circuit 17'.

Said first category of sensor units (10, 10*a*) may be designed to determine the energy content of the particle present by means of temperature sensing, wave-length analysis and/or one or more second sensor units.

Said second category of sensor units (10', 10*b*') may be designed to determine the tendency of the particle surroundings to fire or other damage, when this temperature sensing relates to the of the material being transported.

Also falling within the scope of the invention is the possibility of allowing one sensor unit from said second category of sensor units to be designed to be able to determine the tendency of the particle surroundings to fire or other damage by means of moisture sensing.

A sensor unit might also be designed to be able to determine the tendency of the particle surroundings to fire or other damage by means of sensed oxygen content.

Yet another sensor unit might be designed to be able to stipulate the tendency of the particle surroundings to fire or other damage by means of an evaluation of the dust concentration.

A sensor unit within this second category might also be designed to be able to determine the tendency of the particle surroundings to fire or other damage by means of evaluation of the particle size, the particle size being determined by the nature of the transported material.

The invention may also make use of a sensor unit designed to be able to determine the tendency of the particle surroundings to fire or other damage by sensing the turbulence intensity.

Also failing within the scope of the invention is the possibility of allowing the sensor unit for the second category be designed to be able to determine the tendency of the particle surroundings to fire or other damage by means of sensed ignition temperature. Alternatively the ignition energy of the transported material may be evaluated.

The possibility naturally falls within the scope of the invention of co-ordinating one or more of the sensor units in the first category with one or more of the sensor units in the second category and/or having a selected output signal weighted in comparison with the others in order to be able with greater accuracy to determine a relevant value (R) for the tendency to fire or other damage.

An alternative possibility, of allowing determination of when a combination between the energy content of particles and the tendency of the media flow gives an indication of danger or not, is shown in FIG. 4.

Here the energy content E of the particle is shown as values 0–10 on the y-axis, while the fire tendency B of the media flow is shown as values 10–0 on the x-axis, and where said values may be calculated in accordance with a selected algorithm.

The curve according to FIG. 4 may be considered applicable for one of several risk sources (thermal content in the particle) and a single category or a mixture in the media flow, and several such graphs are preferably required to determine a final value.

The area 40 in this example may be considered as a safe zone and no action need be taken for particles having an energy content below the line 41 and a fire tendency below the line 41. High energy content (6 on the y-axis) and little fire tendency (0 on the x-axis) can be accepted, but a high energy content (6 on the y-axis) and high fire tendency (5 on the x-axis) require action via the activation unit 18.

The line 42 shall be considered as the physical limit at and above which fire or other damage will occur if no fire-restricting action is taken via the activation unit 18.

The area 43 situated between the lines 41 and 42 constitutes an area in which every incident must be carefully checked and only with the guidance of additional criteria is it advisable to finally choose courses of action.

The expression that the evaluating unit can be coordinated with an activating unit so that the latter passes from a first position to a second position shall not necessarily be interpreted as a rocker function. It may instead be a question of a choice of one or more of numerous available courses of action.

The invention is naturally not limited to the embodiment described above by way of example, but may be modified within the scope of the inventive concept illustrated in the appended claims.

What is claimed is:

1. A detector arrangement adjustable for inclusion in a preventive protective system for a process plant comprising at least two sensor units each for producing an ouput signal; an evaluating unit for each sensor unit for evaluating the output signal of each sensor unit; and an activating unit cooperating with the evaluating units, said activating unit being responsive to the output signals from the evaluating units for switching from a first position to a second position, characterized in that one or more sensor units falling within a first category is designed, via its circuit for evaluating output signals, to be able to determine the energy content of a particle present, in that one or more sensor units falling within a second category is designed, via its circuit for evaluating output signals, to be able to determine the fire tendency or tendency to some other damage of the particle surroundings, and in that the activating unit is designed to pass from a first position to a second position only when the combined energy content and the tendency determined indicate high risk of fire or other damage.

2. A detector arrangement as claimed in claim 1, characterized in that one or more sensor units within said first category of sensor units is designed to determine the energy content of a particle occurring, by means of temperature sensing, wave-length analysis.

3. A detector arrangement as claimed in claim 1, characterized in that one or more sensor units within said second category of sensor units is designed to be able to determine the fire tendency or tendency to other damage of the particle surroundings by means of temperature sensing.

4. A detector arrangement as claimed in claim 1, characterized in that one or more sensor units within said second category of sensor units is designed to be able to determine the fire tendency or tendency to other damage of the particle surroundings by means of sensed oxygen content.

5. A detector arrangement as claimed in claim 1, characterized in that one or more sensor units within said second category of sensor units is designed to be able to determine the fire tendency or tendency to other damage of the particle surroundings by means of sensed oxygen content.

6. A detector arrangement as claimed in claim 1, characterized in that one or more sensor units within said second category of sensor units is designed to be able to determine the fire tendency or tendency to other damage of the particle surroundings by means of sensed dust concentration.

7. A detector arrangement as claimed in claim 1, characterized in that one or more sensor units within said second category of sensor units is designed to be able to determine the fire tendency or tendency to other damage of the particle surroundings b means of sensed particle size.

8. A detector arrangement as claimed in claim 1, characterized in that one or more sensor units within said second category of sensor units is designed to be able to determine the fire tendency or tendency to other damage of the particle surroundings by means of sensed turbulence intensity.

9. A detector arrangement as claimed in claim 1, characterized in that one or more sensor units within said second category of sensor units is designed to be able to determine the fire tendency or tendency to other damage of the particle surroundings by means of sensed ignition temperature.

10. A detector arrangement as claimed in claim 1, characterized in that one or more sensor units within said second category of sensor units is designed to be able to determine the fire tendency or tendency to other damage of the particle surroundings by means of sensed ignition energy.

11. A detector arrangement as claimed in claim 1, characterized in that the unit evaluating the output signal of each sensor unit emits its own value, one representing the energy content, one representing the fire tendency or tendency to other damage of the particle surroundings, and in that a list or algorithm included in a calculation unit determines if and how the activation circuit shall be affected.

12. A detector arrangement as claimed in claim 1, characterized in that at least the output signal of one selected unit is connected to a calculation unit in order, via this and weighted, to permit evaluation of a selected activation of the activation circuit.

* * * * *